US007589704B2

(12) United States Patent
Goder et al.

(10) Patent No.: US 7,589,704 B2
(45) Date of Patent: Sep. 15, 2009

(54) SMART TALK BACKLIGHTING SYSTEM AND METHOD

(75) Inventors: Dimitry Goder, San Jose, CA (US); Gi Young Lee, Saratoga, CA (US); Quoi Van Huynh, Saratoga, CA (US); Chris Tzuchun Lee, San Jose, CA (US)

(73) Assignee: Exar Corporation, Fremont, CA (US)

( * ) Notice: Subject to any disclaimer, the term of this patent is extended or adjusted under 35 U.S.C. 154(b) by 140 days.

(21) Appl. No.: 11/440,757

(22) Filed: May 25, 2006

(65) Prior Publication Data

US 2007/0273676 A1 Nov. 29, 2007

(51) Int. Cl.
*G09G 3/36* (2006.01)

(52) U.S. Cl. ..... 345/89; 345/207

(58) Field of Classification Search ..... 315/291, 315/307, 224, 297, 360, 185 S; 363/89, 21.11, 363/21.7, 21.9; 345/82, 212, 207, 214, 89, 345/99, 690; 307/85, 86

See application file for complete search history.

(56) References Cited

U.S. PATENT DOCUMENTS 6,963,323 B2 * 11/2005 Sakurai et al. ..... 345/89
7,312,783 B2 * 12/2007 Oyama ..... 345/102

OTHER PUBLICATIONS

International Search Report for PCT/US07/69396, dated Dec. 5, 2008, 7 pages.

* cited by examiner

*Primary Examiner*—Rajnikant B Patel
(74) *Attorney, Agent, or Firm*—Fliesler Meyer LLP

(57) ABSTRACT

A smart talk mechanism provides feedback information from a driver to a DC-to-DC converter, enabling the DC-to-DC converter to adjust an input voltage for at least one illumination source backlighting the display for increasing the power efficiency.

7 Claims, 4 Drawing Sheets

SMART TALK BACKLIGHTING SYSTEM AND METHOD

COPYRIGHT NOTICE

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

FIELD OF THE INVENTION

The invention relates generally to backlight display driver circuits, and more particularly to backlight display driver circuits with feedback mechanisms.

BACKGROUND

Liquid Crystal Displays (LCDs) can be used for a number of applications such as in laptop and other computer displays, televisions, global positioning (GPS) units, and in personal data assistants (PDAs), and for many other applications. Conventionally, Light Emitting Diodes (LED) may be used to backlight the LCD display for greater brilliance. Conventional LED backlighting suffers from a drawback, however. The use of the LEDs increases power consumption, often to the point of eliminating the advantage of using LCD technology. Accordingly, mechanisms for reducing the power consumed by LEDs used to backlight LCD displays are sought.

BRIEF DESCRIPTION OF THE DRAWINGS

Preferred embodiment(s) of the present invention will be described in detail based on the following figures, wherein.

DETAILED DESCRIPTION

Figure 1:
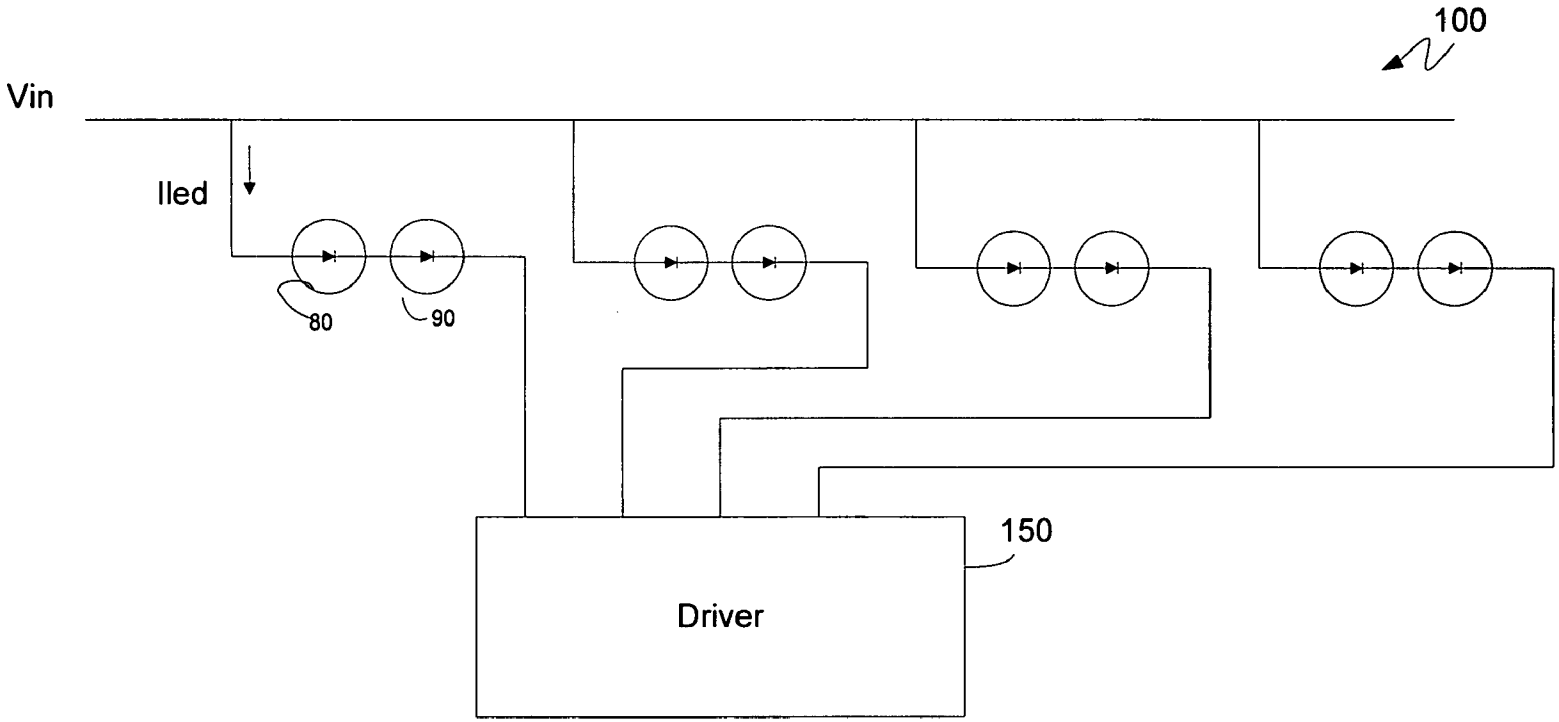
FIG. 1 illustrates an example of a driver circuit for driving LEDs used to backlight an LCD display.

FIG. 1 shows a driver circuit 100, in which a driver device is used to drive LEDs used to backlight an LCD display. The driver circuit 100 can include driver device 150, which may be an SP7617 backlight driver device made by SIPEX Corporation of Milpitas, Calif. While many embodiments can be prepared incorporating a variety of other driver devices, the SP7617 provides a four channel low side driver having maximum 60 mA current, current accuracy of about 2.5% and approximately 1% current matching between channels over a full temperature range, pulse width modulation and analog dimming control and short LED and thermal and over current protections. In operation, an input voltage Vin is applied to each channel, causing a current of lied to flow through each channel and through the driver device 150. Current Iled causes a voltage drop of Vf across each LED 80, 90. In an example operational context having values of Vin of 21 volts, lied of 20 mA per channel and Vf of 3.5 volts, the power P dissipated by device driver is computed according to relationship (1):

$$P=[21\text{V}-(2.5\text{V}\times 2)]\times(20\text{ mA}\times 4)=1.12\text{ Watts} \quad (1)$$

Figure 2:
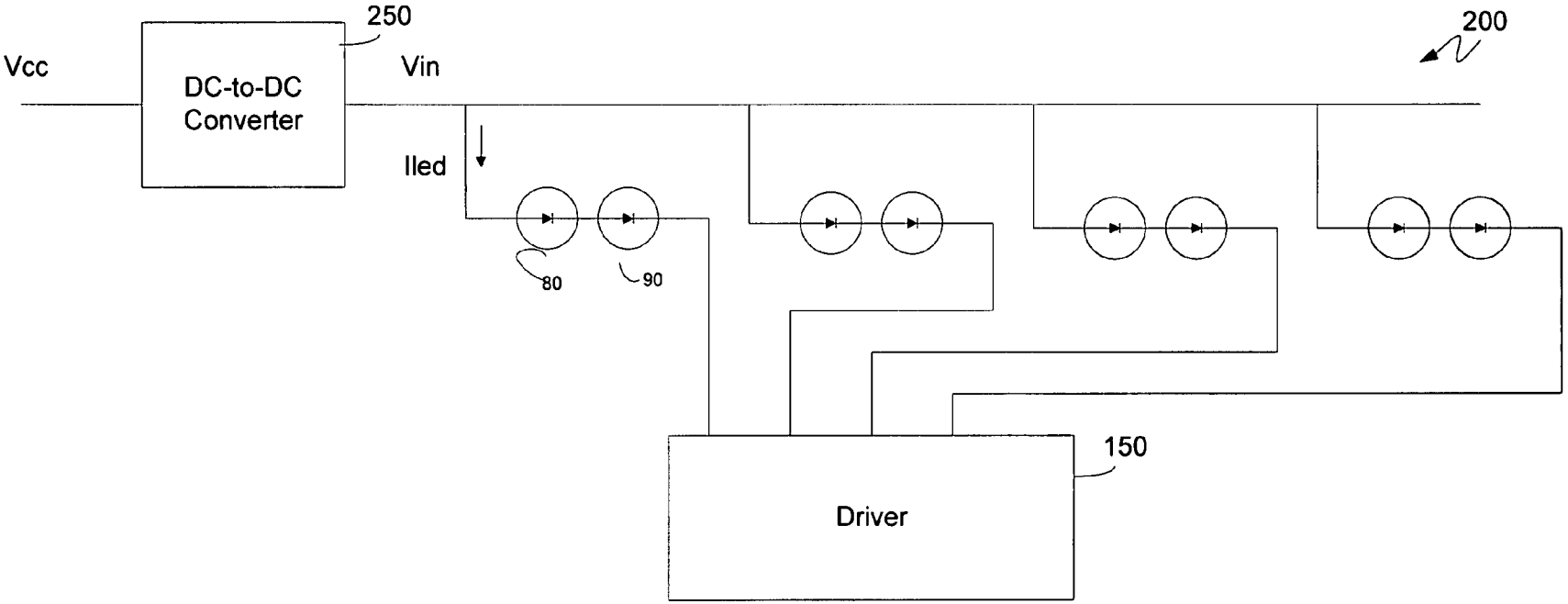
FIG. 2 illustrates an improved driver circuit.

FIG. 2 illustrates a modified driver circuit 200, in which a DC-to-DC converter 250 has been added in an effort to reduce power dissipation. As shown by FIG. 2, a DC-to-DC converter, such as SP6125 by SIPEX Corporation, provides a relatively higher efficiency step down conversion from the Vin to a preferred Vcc. In an operational context, Vin may be 21 volts and Vcc may be 9 volts and DC-to-DC converter 250 may have an efficiency of 90%, for example, an overall efficiency of approximately 70% may be achieved according to the relationship (2):

$$E\text{overall}=90\%\times 78\%=70\% \quad (2)$$

It is noteworthy that embodiments of the present invention are not limited to a step-down (buck) converter, such as the SP6125, but can also enable use of step-up (boost) converters as well. Additionally, embodiments may be realized using a pulse width modulator (PWM) as a specific implementation for the DC-to-DC converter.

Efficiencies greater than those provided by the architectures shown in FIG. 1 and FIG. 2 are desired. Addition of a power saving feedback from the driver to the DC-to-DC converter mechanism would result in an advantageous efficiency improvement over the architectures of FIG. 1 and FIG. 2.

Figure 3:
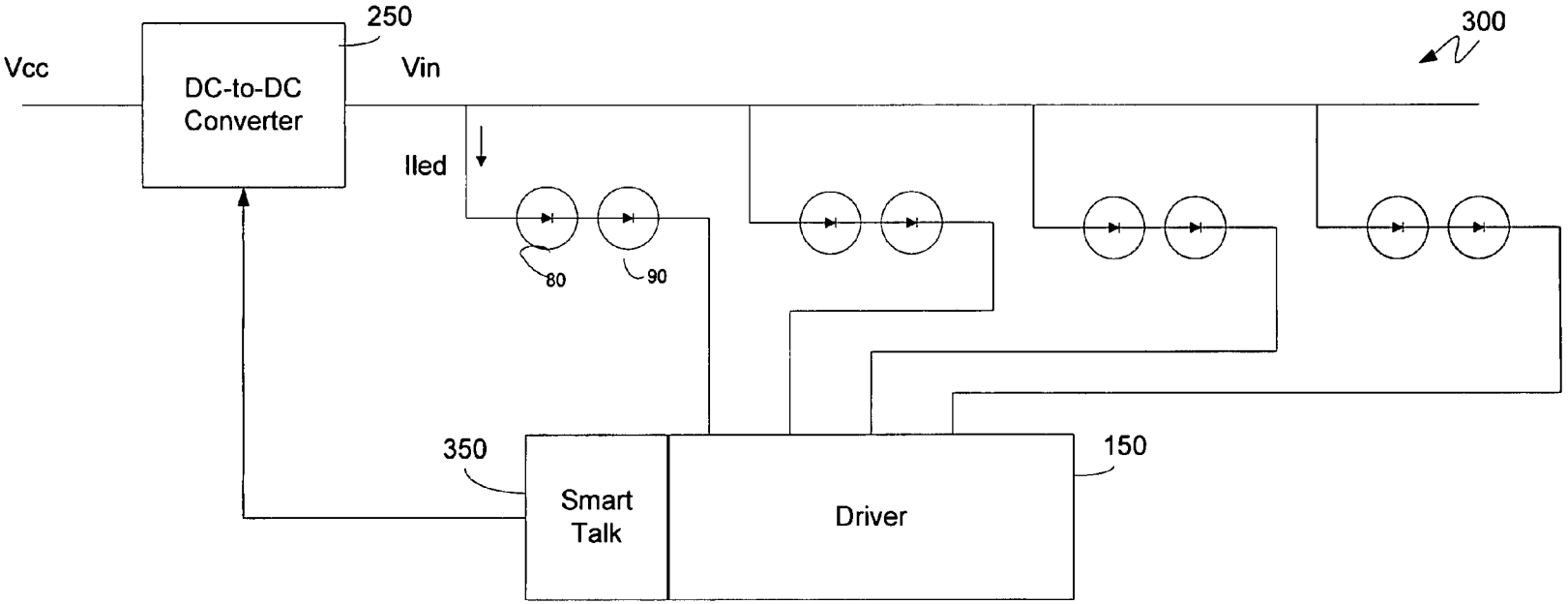
FIG. 3 illustrates an improved driver circuit employing smart talk in an embodiment.

In one embodiment shown in FIG. 3, a power saving feedback from the driver to the DC-to-DC converter mechanism 350 (hereinafter, "smart talk mechanism") is coupled to the driver 150 in order to feed back adjustment information from the driver 150 to the DC-to-DC converter 250, enabling the DC-to-DC converter to adjust Vcc to reduce the Vcathode at the LEDs 80, 90. In an operational example, Vcathode could be reduced to 7.3 volts by action of smart talk mechanism 350 and DC-to-DC converter 250. If the efficiency of the DC-to-DC converter 250 is approximately 93% and the efficiency of driver 150 and smart talk mechanism is about 96%, for example, an overall efficiency of approximately 90% may be achieved according to the relationship (3):

$$E\text{overall}=93\%\times 96\%=90\% \quad (3)$$

The operation of smart talk mechanism 350 can provide improved efficiency over the circuits illustrated by FIG. 1 and FIG. 2. Functionality of a smart talk mechanism suitable for use in the back light display driver of FIG. 3 will now be described in further detail with reference to FIGS. 4A-4B.

Figure 4A:
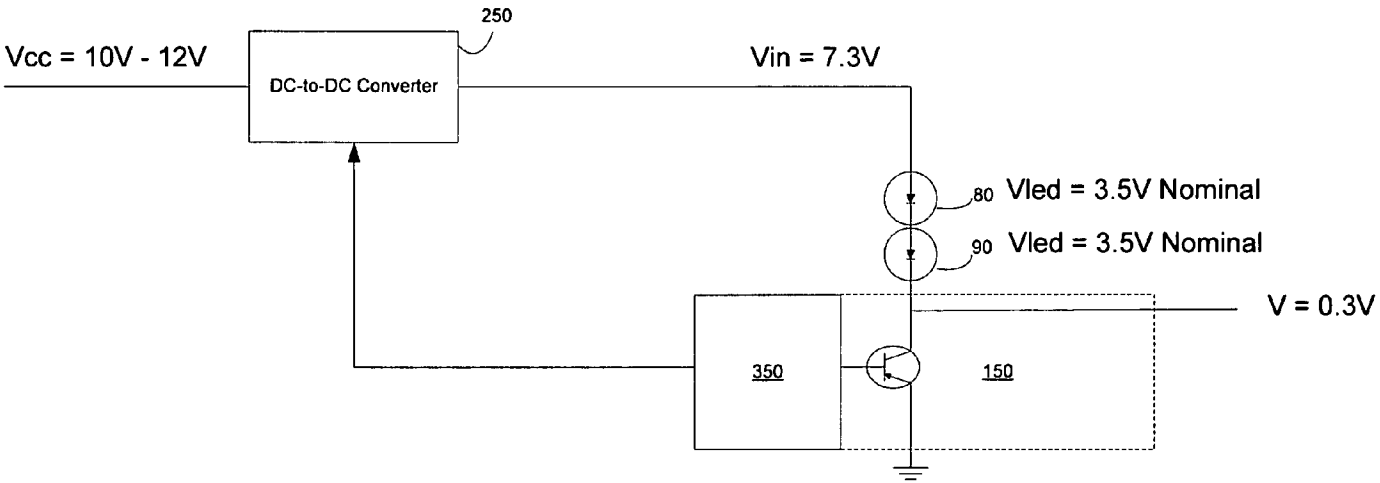
FIG. 4A illustrates functionality of an embodiment employing power saving feedback from the driver to the DC-to-DC converter.
Figure 4B:
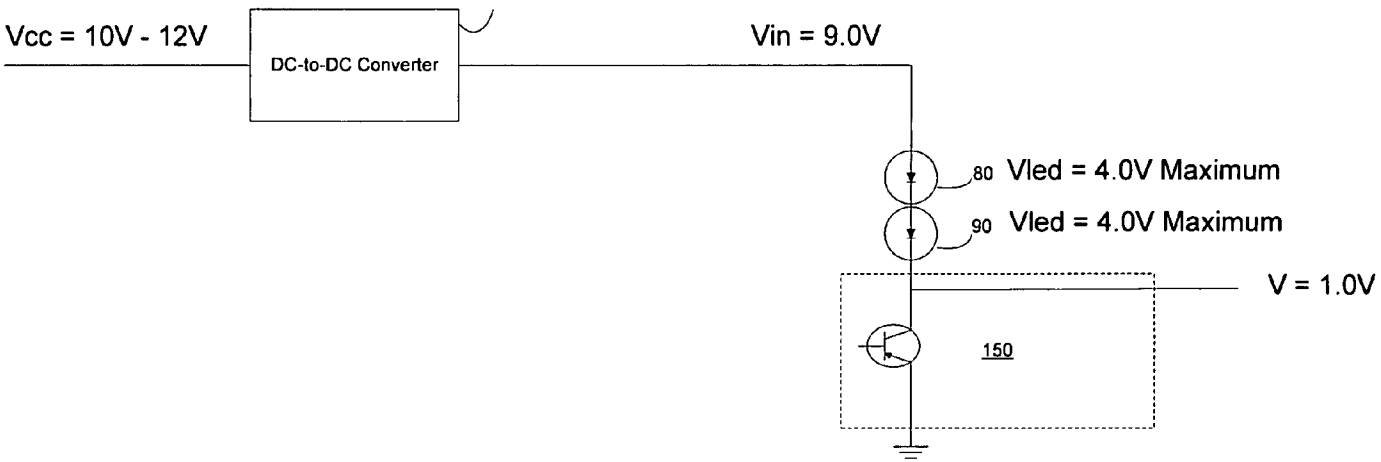
FIG. 4B illustrates functionality of an embodiment without power saving feedback from the driver to the DC-to-DC converter.

FIGS. 4A-4B illustrate a comparison of an embodiment employing power saving feedback from the driver to the DC-to-DC converter provided by a smart talk mechanism with an embodiment without the power saving feedback. As shown by FIG. 4A, smart talk mechanism 350 is coupled to the driver 150 in order to feed back adjustment information from the driver 150 to the DC-to-DC converter 250.

In an embodiment, the DC-to-DC converter 250, by nature of its design, continuously adjusts its outputs voltage around an optimum feedback voltage. Normally, the feedback voltage for the DC-to-DC converter 250 is a directly scaled version of the output voltage. The smart talk mechanism will take the information of the anode voltage (at the driver output) and feed that back to the DC-to-DC converter 250. This information can be a direct anode voltage or a scaled version of it. If this feedback voltage is high, then the DC-to-DC converter 250 will decrease it output to lower the cathode voltage and hence lower the anode voltage as well. If the feedback voltage is low, the then the DC-to-DC converter 250 will increase its output to raise the cathode voltage and hence raise the anode voltage as well. This mechanism will ensure the anode voltage to be at an optimum voltage which maximizes the intended power to the LEDs and reduces the power loss inside the driver.

The feedback enables the DC-to-DC converter to adjust Vcc to reduce the Vin at the cathode end of LED 80 from 9.0V, as shown by FIG. 4B, to 7.3V shown in FIG. 4A. The voltage drop across LEDs 80, 90 is reduced from a maximum value of 4.0V in FIG. 4B to a nominal value of 3.5V in FIG. 4A. Finally, voltage across a driver transistor within driver 150 can be dropped from 1.0V in FIG. 4B to 0.3V in FIG. 4A. These and other benefits provided by embodiments employing a smart talk mechanism can improve efficiency, reduce power dissipation, enhance battery life and so forth.

Embodiments providing a larger quantity of channel drivers may be created using the techniques described above to reduce power dissipation in the device driver. For example, and without limitation, embodiments having four, eight or larger quantities of channel drivers may be realized in accordance with the techniques described herein. In embodiments, input power is derived from one or more of a battery and an AC adapter. According to embodiments, the efficiency of a backlight LED driver is increased from about 33% to about 90% and power dissipation is reduced by approximately 64%.

The foregoing description of the present invention has been provided for the purposes of illustration and description. It is not intended to be exhaustive or to limit the invention to the precise forms disclosed. Many modifications and variations will be apparent to the practitioner skilled in the art. Particularly, it will be evident that the above-described features of detecting and ranking images with numerical ranks in order of usefulness based on vignette score can be incorporated into other types of software applications beyond those described. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalents.

What is claimed is:

1. A circuit to drive a backlight for a display comprising:

a backlight device driver;

a DC-to-DC converter; and a smart talk mechanism to feed back adjustment information from the driver to the DC-to-DC converter, thereby enabling the DC-to-DC converter to adjust an input voltage for at least one illumination source backlighting the display for increasing the power efficiency;

wherein the smart talk mechanism uses a voltage at the device driver to determine the adjustment information;

wherein the backlight device drives at least one LED for the backlight, the feedback mechanism reducing the voltage at a cathode of the LED;

wherein the reduction of the cathode voltage is done by continuously adjusting an anode voltage;

wherein the driver output is used to produce the adjustment information and feed that back to the DC-to-DC converter; and wherein if the anode voltage is high, then the DC-to-DC converter will decrease its output to lower the cathode voltage and hence lower the anode voltage as well, if the anode voltage is low, then the DC-to-DC converter will increase its output to raise the cathode voltage and hence raise the anode voltage as well.

2. The circuit of claim 1, wherein the backlight device driver drives the light emitting diode (LED) back light for a liquid crystal display (LCD).

3. The circuit of claim 1, wherein the display includes a liquid crystal display (LCD).

4. The circuit of claim 1, wherein the driver comprises a multi-channel driver.

5. The circuit of claim 1, wherein the DC-to-DC converter adjusts a voltage to the backlight of the display.

6. The circuit of claim 1, wherein input power is derived from at least one of a battery and an AC adapter.

7. The circuit of claim 1, wherein the DC-to-DC converter comprises a pulse width modulator (PWM).

* * * * *